United States Patent [19]

Martin et al.

[11] 4,052,004

[45] Oct. 4, 1977

[54] VIBRATORY ATOMIZER

[75] Inventors: Barrie James Martin, Shenfield; Victor Ernest Bridger, London, both of England

[73] Assignee: Plessey Handel und Investments AG, Zug, Switzerland

[21] Appl. No.: 659,156

[22] Filed: Feb. 18, 1976

[30] Foreign Application Priority Data

Feb. 19, 1975 United Kingdom ..... 6949/75

[51] Int. Cl.[2] ..... B05B 3/14

[52] U.S. Cl. ..... 239/102; 239/282

[58] Field of Search ..... 239/102, 282; 310/8.2, 310/9.1

[56] References Cited

U.S. PATENT DOCUMENTS

| | | | |
|---|---|---|---|
| 3,394,274 | 7/1968 | Jacke et al. | 310/8.2 X |
| 3,443,130 | 5/1969 | Shoh | 310/8.2 X |
| 3,591,862 | 7/1971 | Winston | 310/8.2 |
| 3,772,538 | 11/1973 | Supitilov | 310/8.2 X |
| 3,783,309 | 1/1974 | Alibert et al. | 310/8.2 X |
| 3,790,079 | 2/1974 | Berglund et al. | 239/102 |
| 3,861,852 | 1/1975 | Berger | 239/102 X |

*Primary Examiner*—John J. Love

*Attorney, Agent, or Firm*—Fleit & Jacobson

[57] ABSTRACT

A vibratory atomizer for atomizing a liquid, the horn and piezoelectric crystal being housed in a housing but separated from the housing by a rubber O-ring so that energy loss to the housing is minimized.

5 Claims, 4 Drawing Figures

VIBRATORY ATOMIZER

This invention relates to vibratory atomizers for atomizing a liquid, for example ultrasonic atomizers for atomizing liquid fuel.

It is difficult in practice to determine accurately the vibration node of a vibratory atomizer. The vibratory node is required to be determined so that the atomizer may be rigidly secured in the region of the vibration node to an associated mounting. Because there is virtually no vibration at the vibration node, little or no energy is thus lost from the atomizer into the mounting during periods when the atomizer is being vibrated.

Hitherto, it has been customary only to take into account vibrations in the longitudinal direction of the atomizer. Radial vibrations and radial movement due to Poissons ratio effect have hitherto been neglected. This has mainly been because it is virtually impossible to find a plane of zero vibrations in both the longitudinal and transverse planes. Since the radial vibrations and radial movements are neglected, energy loss from the atomizer to its mounting occurs.

It is an aim of the present invention to minimise or reduce the energy loss from the atomizer to its mounting during periods when the atomizer is being vibrated.

Accordingly, this invention provides a vibratory atomizer for atomizing a liquid due to vibrations of the atomizer, which atomizer comprises a nozzle portion from which the liquid is ejected, a body portion having vibration means, a cover which fits over the body portion, and resilient means adapted to mount the body portion within the cover.

Preferably, the resilient means is the sole mounting for the body portion within the cover and in this case, the body portion will usually not touch the cover. The resilient means is preferably also adapted to engage the mounting surface, thereby to provide a seal at the point of engagement.

The resilient means is preferably formed separately from the body portion of the atomizer and it may then be mounted in various ways. For example, the body portion of the atomizer may be provided with an outwardly extending diaphragm over which the resilient means fits. Advantageously, the resilient means is made of a synthetic or natural rubber although other materials can be employed if desired. The resilient means may take the form of a rubber O-ring and the O-ring can be slotted so that it can be a friction fit on the outwardly extending diaphragm. Alternatively, the resilient means, e.g., the rubber O-ring, can be located partially in a groove formed in the cover and/or partially in a groove formed in the body portion.

The cover may be provided with a mounting flange. In this case, the mounting flange can be provided with apertures by which the flange can be screwed or bolted to a mounting surface. The precise mounting surface will obviously vary depending upon the use to which the atomizer of the invention is to be put. Thus, for example, in the case where the atomizer is to be used to inject fuel into the engine of a vehicle, then the mounting surface may form part of the manifold. In the case where the atomizer is to be used to inject fuel into a boiler for use, for example, in central heating systems, then the mounting surface may form part of the boiler engine or the inlet to the boiler engine.

Preferably, the cover is provided with an aperture for receiving therethrough an electrical lead. The electrical lead may have an electrode such for example as a flat electrode at its end which is within the cover and is thus protected by the cover. The atomizer may then be provided with a spring contact which presses on the electrode of the lead. The spring contact may be fixed by various means, e.g., brazing, to the atomizer and it will be apparent that if the lead is inadvertently pulled or subjected to other forces during use of the atomizer, then these forces stresses will not be transmitted to the spring contact. Thus, the possibility of pulling the spring contact off the atomizer is avoided.

The resilient means may enable the nozzle and body portions of the atomizer to vibrate with respect to the mounting surface and the cover in both the longitudinal and transverse directions. Thus the atomizer need not necessarily be precisely located in a plane or node of zero vibration since the resilient means helps to prevent the loss of energy from the atomizer to its associated mounting.

Usually, the vibratory atomizer will be vibrated with ultrasonic vibrations. In practice, the lower limit of these ultrasonic vibrations may be near the upper limit of audibility to the human ear. However, it is desirable that the vibrations will be of such frequency that they cannot normally be heard by the human ear, thereby avoiding undue noise.

The vibrations may be effected by means of a piezoelectric device or by means of an electromagnetic device. Appropriate vibratory devices are well known in the art. It is presently preferred that the vibratory device be a piezoelectric crystal which can be secured to the body portion of the vibratory atomizer. The spring contact mentioned above can, if desired, be fixed to the piezoelectric crystal.

The atomizer of the present invention is preferably employed as an ultrasonic fuel atomizer for injecting fuel into engines or boilers. However, if desired, the atomizer may be used to inject other liquids such, for example, chemicals and paint. When the atomizer is used for injecting fuel, it is preferably of the type having its fuel line blocked by a non-return valve, e.g., a ball valve, except for periods when the atomizer is vibrated. However, if desired, the atomizer could have an unblocked fuel line, in which case it may continuously inject a jet of fuel, which jet will become atomized when the atomizer is vibrated.

Embodiments of the invention will now be described by way of example and with reference to the accompanying drawings in which.

Figure 1:
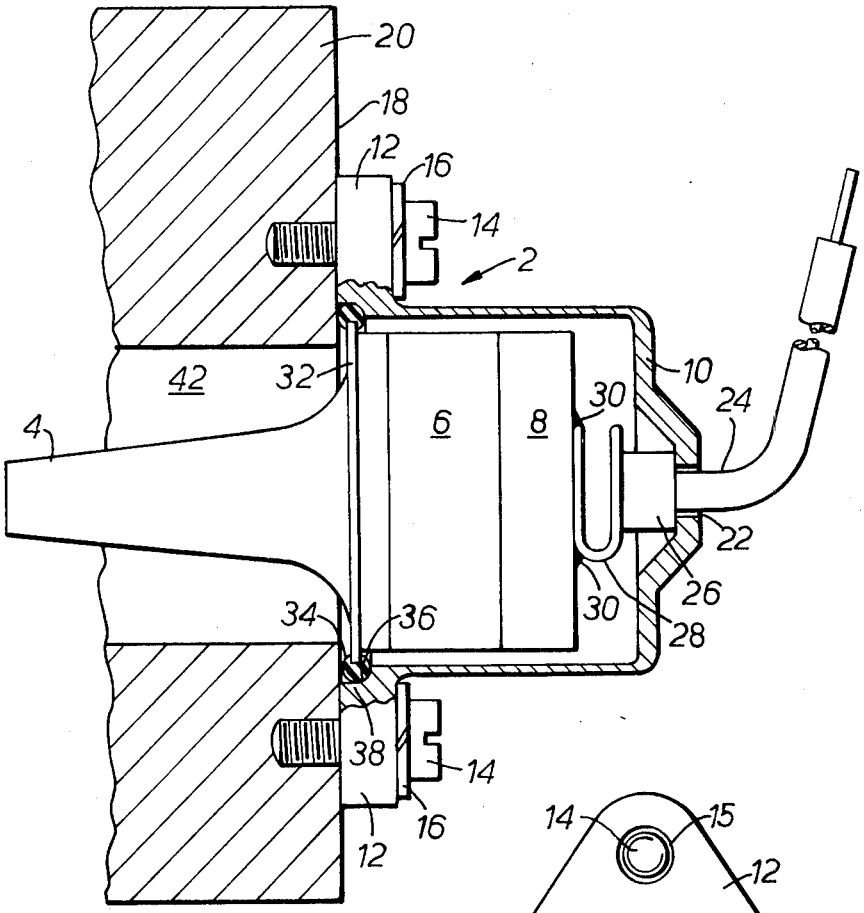
FIG. 1 shows a first vibratory atomizer in accordance with the invention positioned on an engine manifold.
Figure 2:
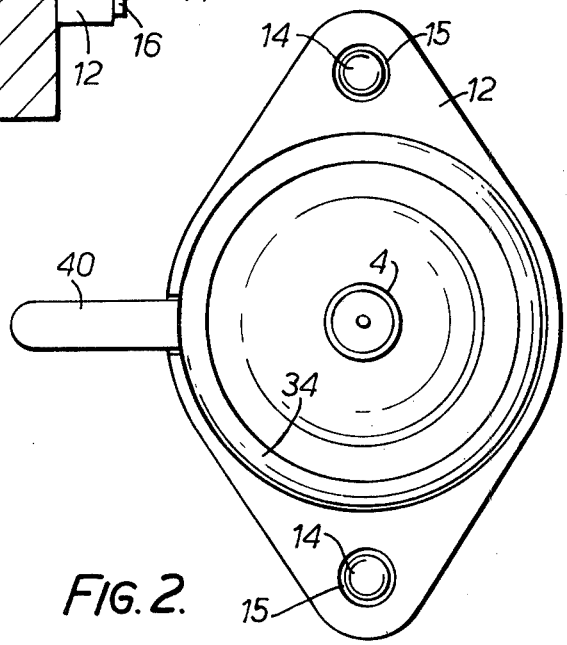
FIG. 2 is an end view of the atomizer as shown in FIG. 1 locking from left to right and without the engine manifold.

Referring to FIGS. 1 and 2, there is shown a vibratory atomizer 2 comprising a nozzle portion 4 from which a liquid is ejected, and a body portion 6 having attached thereto vibration means in the form of a piezoelectric crystal 8. The atomizer 2 also comprises a cover 10 which fits over the body portion 6 and which is provided with a flange 12 having apertures for receiving screws 14. As shown in FIG. 2 the screws 14 pass through the apertures 15 in the flange 12, via spring washers 16, and enable the flange 12 to be tightly screwed down on to the surface 18 of an engine manifold 20.

The cover 10 is provided with a centrally disposed aperture 22 through which passes an electrical lead 24. The lead 24 terminates in a block electrode 26 which engages with a copper spring contact 28. The contact 28 is brazed or otherwise connected at points 30 to the surface of the piezoelectric crystal 8.

The body portion 6 is provided with an outwardly extending circumferential flange 32 which may be made of thin metal. A rubber O-ring 34 is slotted and fits over the flange 32. The O-ring 34 thus provides the sole means by which the body portion 6 and the piezoelectric crystal 8 are mounted within the cover 10. As shown in FIG. 1, the O-ring 34 fits in a recessed portion 36 formed by a shoulder 38 provided in the flange 12. The O-ring 34 is thus pressed against the surface 18 of the manifold 20 when the screws 14 are tightened and provides a seal at this point so that gases in the manifold space 42 do not escape.

In operation of the atomizer 2, appropriate electrical energy is passed along the lead 24 and reaches the piezoelectric crystal 8 via the contacts 26, 28. The piezoelectric crystal 8 is thus energised and the nozzle and body portions 4, 6 vibrate. Fuel passes along a fuel pipe 40 (FIG. 2) and enters the body portion 6 and is passed to the nozzle portion 4. The vibration of the nozzle and body portions 4, 6 causes the fuel to leave the nozzle portion 4 in finely atomized form.

It will be appreciated that the rubber O-ring 34 allows the nozzle and body portions 4, 6 to vibrate with respect to the cover 10 and manifold 20, whilst at the same time minimizing the loss of energy from the portions 4, 6 to the cover 10 and manifold 20.

Figure 3:
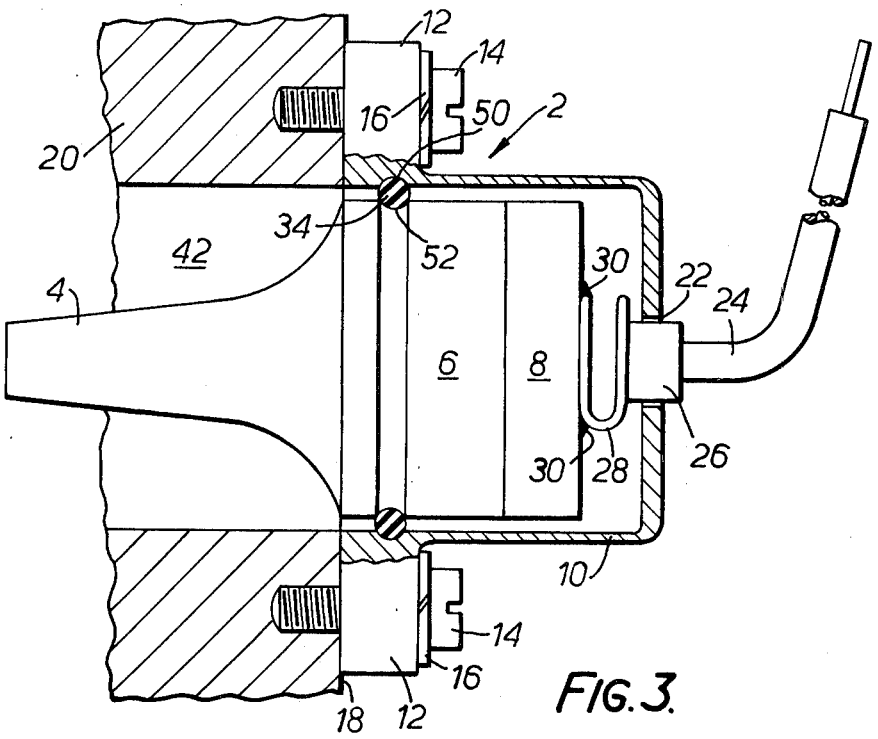
FIG. 3 shows a second vibratory atomizer in accordance with the invention positioned on an engine manifold.
Figure 4:
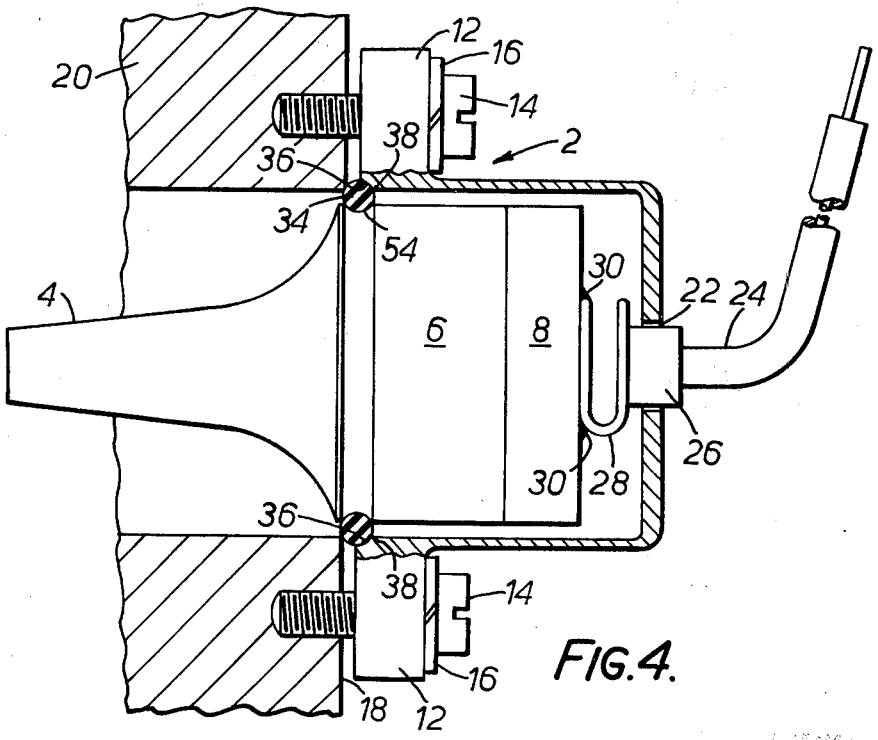
FIG. 4 shows a third vibratory atomizer in accordance with the invention positioned on an engine manifold.

Referring now to FIGS. 3 and 4, the vibratory atomizers shown are similar to those shown in FIGS. 1 and 2 and similar parts have been given the same reference numerals.

In FIG. 3, the rubber O-ring 34 is not slotted and it is located partially in a groove 50 in the cover 10 and partially in a groove 52 in the body 6.

In FIG. 4, the rubber O-ring 34 is also not slotted and it is located partially in the recessed portion 36 and partially in a groove 54 formed in the body 6. In FIG. 4, the O-ring 34 also seats against the surface 18 of the engine manifold 20 to effect a sealing action. This sealing action is not present in the vibratory atomizer shown in FIG. 3.

The embodiments of the invention described above have been given by way of example only and modifications may be effected. Thus, for example, a rubber seal of square or rectangular cross section could be employed if desired. Also, the piezoelectric crystal 8 could be replaced by an electromagnetic arrangement provided around the body portion 6.

What we claim is:

1. A vibratory atomizer for atomizing a liquid due to vibrations of the atomizer, which atomizer comprises a nozzle portion from which the liquid is ejected, a body portion having vibration means, a cover which fits over the body portion, and resilient means adapted to mount the body portion within the cover, wherein said cover is fastened to a mounting surface and in which said resilient means engages the mounting surface, thereby to provide a seal at the point of engagement, and the body portion and the cover both having means for positively locating the resilient means whereby the resilient means constitutes the sole means for mounting the body portion within the cover.

2. A vibratory atomizer according to claim 1 in which the resilient means is a rubber O-ring.

3. A vibratory atomizer according to claim 2 in which the rubber O-ring is slotted and fits over an outwardly extending diaphragm provided on the body portion.

4. A vibratory atomizer according to claim 3 in which the rubber O-ring partially fits in a groove in the body portion.

5. A vibratory atomizer according to claim 1 in which the cover is provided with a mounting flange for fastening to the mounting surface.

* * * * *